US006926386B2

(12) United States Patent
Shin et al.

(10) Patent No.: US 6,926,386 B2
(45) Date of Patent: Aug. 9, 2005

(54) INKJET PRINTER HEAD AND METHOD OF FABRICATING THE SAME

(75) Inventors: Jong-Cheol Shin, Suwon (KR); Kwang-Joon Yoon, Suwon (KR); Sung-Joon Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/603,828

(22) Filed: Jun. 26, 2003

(65) Prior Publication Data

US 2004/0017441 A1 Jan. 29, 2004

(30) Foreign Application Priority Data

Jun. 26, 2002 (KR) ..... 10-2002-0035922

(51) Int. Cl.[7] ..... B41J 2/195
(52) U.S. Cl. ..... 347/47
(58) Field of Search ..... 347/20, 40, 47, 347/54, 56, 61, 64–66, 68; 430/320; 216/27

(56) References Cited

U.S. PATENT DOCUMENTS 5,719,605 A * 2/1998 Anderson et al. ..... 347/59
6,162,589 A * 12/2000 Chen et al. ..... 430/320
6,241,905 B1 * 6/2001 Silverbrook ..... 216/27
6,261,742 B1 * 7/2001 Chen et al. ..... 430/320
6,502,921 B2 * 1/2003 Kanda et al. ..... 347/40
6,534,247 B2 * 3/2003 Milligan et al. ..... 430/320
6,641,744 B1 * 11/2003 Kawamura et al. ..... 216/27
6,663,231 B2 * 12/2003 Lee et al. ..... 347/68

OTHER PUBLICATIONS

NN76112255, Nov. 1976, IBM Technical disclosure bulletin.*

* cited by examiner

*Primary Examiner*—Anh T. N. Vo
(74) *Attorney, Agent, or Firm*—Volentine Francos & Whitt PLLC

(57) ABSTRACT

An inkjet printer head includes a semiconductor wafer having a nozzle portion for ejecting ink, an ink cartridge for supplying ink to the nozzle portion, and an ink ejection unit interposed between the ink cartridge and the semiconductor wafer. A method of forming the printer head includes forming an ink ejection unit having an opening on a semiconductor wafer to expose an upper surface of the wafer, etching the wafer through the opening in the ink ejection unit to form a nozzle in the semiconductor wafer, and attaching an ink cartridge to the upper surface of the semiconductor wafer.

15 Claims, 8 Drawing Sheets

INKJET PRINTER HEAD AND METHOD OF FABRICATING THE SAME

BACKGROUND OF THE INVENTION

1. Field of the Invention

The present invention relates to inkjet printer heads and methods of fabricating the same. More particularly, the present invention relates to an inkjet printer head using a semiconductor wafer as a nozzle and to a method of fabricating the same.

2. Background of the Invention

Printers output information processed by a computer and may be classified into three types: dot matrix, inkjet and laser printers.

The dot matrix printer is an impact type of printer that uses carbon paper and is fading in popularity due to its low resolution and loud operation. The laser printer has advantageous operating characteristics of low noise, high speed and high resolution. However, the laser printer also has disadvantageous characteristics of high price and difficulty in printing with color.

On the other hand, the inkjet printer is widely used because of its low noise and facility in printing with color. Inkjet printers may be classified, according to the method in which they eject ink, as piezoelectric, bubble-jet and thermal inkjet printers. However, the bubble-jet printers are similar to the thermal printers in that each use heat for ejecting ink. Thus, inkjet printers may be generally divided into piezoelectric and thermal types of printers.

FIGS. 1 and 2 are a plan view and a cross-sectional view of a conventional inkjet printer head, respectively.

Referring to FIGS. 1 and 2, an opening 15 extends through a semiconductor wafer 10, i.e., between upper and lower surfaces thereof. An ink cartridge is attached to one side of the semiconductor wafer 10. Structures for ejecting ink are disposed on the other side of the semiconductor wafer 10.

The structures for ejecting ink comprise an orifice layer 75, an adhesive layer 70, and a resistor pattern 40. The orifice layer 75 and sidewalls of the adhesive layer 70 constitute an ink chamber 73 for accommodating ink supplied from the ink cartridge. The orifice layer 75 has a cylindrical opening that forms a nozzle portion 77 for focusing ink to one point. The adhesive layer 70 sticks the orifice layer 75 to the semiconductor wafer 10 and forms the sidewalls of the ink chamber 73. Preferably, a support layer 20, formed of an insulating material, is interposed between the resistor pattern 40 and the semiconductor wafer 10.

Heat generated in the resistor pattern 40 by electrical resistance increases the temperature of ink in the ink chamber 73. When the temperature of the ink exceeds the point at which the ink will evaporate, the pressure within the ink chamber 73 becomes high enough to eject ink from the nozzle portion 77 toward the paper.

Meanwhile, the piezoelectric printers differ from the thermal printers in that the piezoelectric printers use a mechanical contraction and expansion of piezoelectric materials for changing the pressure within the ink chamber 73.

According to the conventional printer, ink is supplied to the ink chamber 73 through the opening 15, and is then ejected outwardly from the nozzle portion 77 of the orifice layer 75. Moreover, the adhesive layer 70 and the orifice layer 75 are not formed during the forming of the opening 15 and the resistor pattern 40, but are attached to the semiconductor wafer 10 after being produced separately.

The nozzle portion 77 of the orifice layer 75 should be aligned with the center of the resistor pattern 40 for the ink to be ejected with a high degree of precision. However, the nozzle portion 77 and the resistor pattern 40 are fine structures having widths of several tens to several hundreds of micrometers. Thus, the nozzle portion 77 and the resistor pattern 40 may be misaligned when the orifice layer 75 is attached to the semiconductor wafer 10.

In addition, the ink chamber 73 delimited by the adhesive layer 70 and the orifice layer 75 should be connected with the opening 15 of the semiconductor wafer 10. Thus, the inner sidewalls of the adhesive layer 70 must have a somewhat complicated shape.

Furthermore, according to the conventional printer, the resistor pattern 40 is disposed on one side of the semiconductor wafer 10 as separated from the ink cartridge. This separation gives rise to a residual heat phenomenon, which prevents effective cooling of the resistor pattern 40. Accordingly, the resistor pattern 40 can become overheated and damaged.

SUMMARY OF THE INVENTION

On object of the present invention is to provide an inkjet printer head and a method of fabricating the same, wherein an ink ejection nozzle is precisely aligned with a resistor pattern.

Another object of the present invention is to provide an inkjet printer head and a method of fabricating the same, wherein a resistor pattern can be effectively cooled.

In accordance with one aspect of the present invention, an inkjet printer head comprises a semiconductor wafer having an opening therethrough aligned with an ink ejection unit so as to be used as a nozzle. An ink cartridge is disposed on one side of the semiconductor wafer to supply ink to the nozzle, and the ink ejection unit is interposed between the ink cartridge and the semiconductor wafer.

Preferably, the ink ejection unit includes an electronic element having a resistor or piezoelectric material. An opening is formed in the ink ejection unit. The ink is thus ejected from the ink cartridge through the ink ejection unit and the nozzle of the semiconductor wafer.

The nozzle includes a hemispherical upper portion formed under the opening in the ink ejection unit, and a lower nozzle portion. A supporting layer is interposed between the ink cartridge and the semiconductor wafer and has an opening disposed over the upper portion of the nozzle. In the case in which the ink injection unit includes a resistor, the resistor is patterned and is interposed between the supporting layer and the ink cartridge. The lower nozzle portion extends to the bottom surface of the semiconductor wafer. The central axis of the lower nozzle portion preferably passes through the opening in the supporting layer.

The supporting layer may be formed of at least one material selected from the group consisting of silicon oxide, silicon nitride, and silicon carbide. Preferably, a protection layer, that covers the resistor pattern, is interposed between the supporting layer and the ink cartridge. The protection layer may be formed of at least one material selected from group consisting of silicon oxide, silicon nitride, silicon carbide, and tantalum.

In accordance with another aspect of the present invention, a method of fabricating the inkjet printer head comprises forming an ink ejection unit having an opening therethrough on a semiconductor wafer, etching the semiconductor wafer at the exposed top surface thereof through the opening in the ink ejection unit to form a nozzle from which ink is injected by the printer head, and attaching an ink cartridge to the top surface of the semiconductor wafer to supply ink to the nozzle.

The ink ejection unit may be formed by forming a supporting layer on the semiconductor wafer, forming a resistor pattern on the supporting layer, forming a protection layer over the semiconductor wafer on which the resistor pattern has been formed, and sequentially patterning the protection layer and the supporting layer so as to form the opening through the ink injection unit.

Alternatively, the ink ejection unit may be formed by forming a layer of piezoelectric material on the top surface of the semiconductor wafer.

The nozzle is preferably formed by isotropically and anisotropically etching the wafer. A hemispherical upper portion of the nozzle is produced by the isotropic etching of the semiconductor wafer via the opening in the ink ejection unit. A lower portion of the nozzle is then made by anisotropically etching the wafer at the bottom of the upper portion of the nozzle exposed through the opening. The lower portion of the nozzle can extend partially or all the way through the remainder of the wafer at this time. In the former case, the bottom surface of the wafer is ground until the lower portion of the nozzle is exposed.

In any case, the isotropic etching of the semiconductor wafer is preferably performed using an etch recipe having an etch selectivity with respect to the ink ejection unit. For example, the isotropic etching of the semiconductor wafer may be performed using xenon difluoride as an etching gas.

In addition, another isotropic etching process may be performed after the lower portion of, the nozzle is formed so as to round off the boundary where the lower portion and the upper portion of the nozzle meet.

BRIEF DESCRIPTION OF THE DRAWINGS

The above and other objects, features and advantages of the present invention will become more apparent from the detailed description that follows, made with reference to the accompanying drawings, in which.

DETAILED DESCRIPTION OF THE PREFERRED EMBODIMENTS

Figure 1:
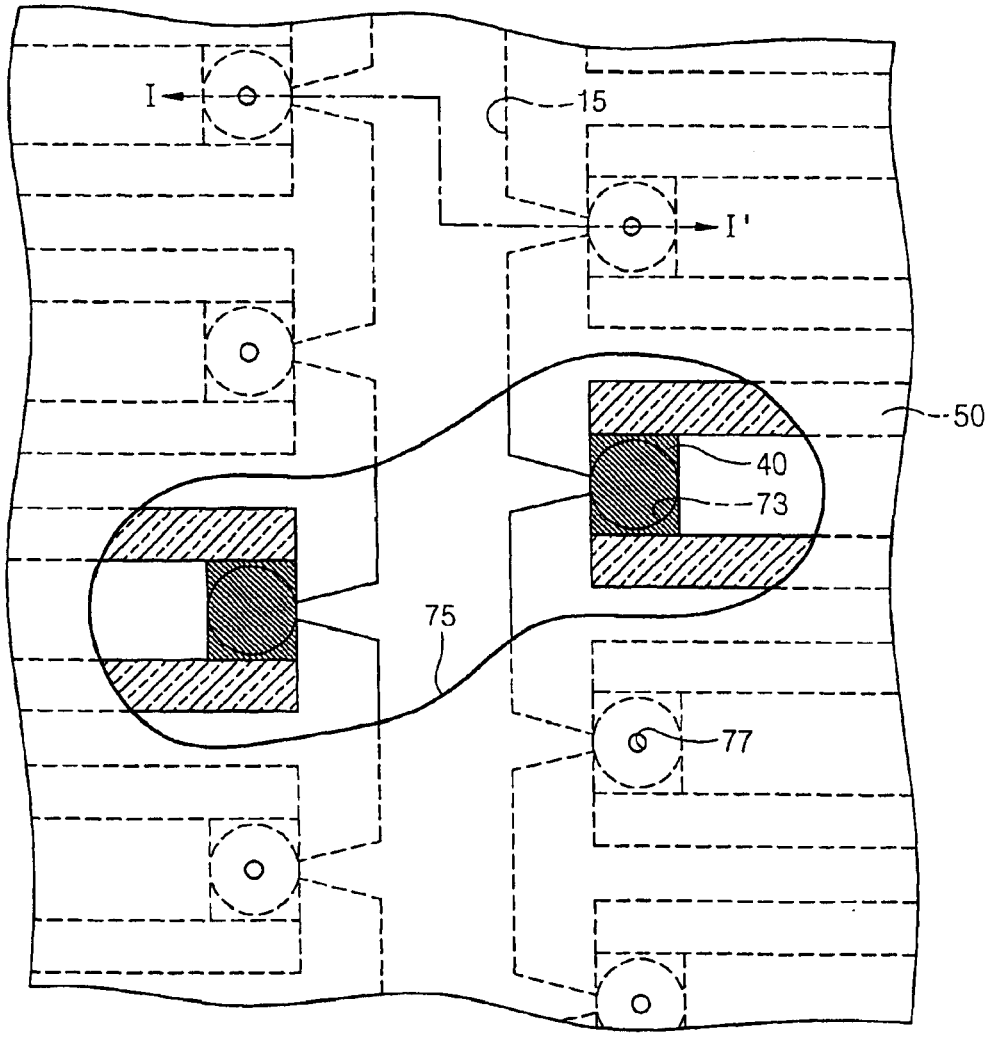
Fig. 1 (PRIOR ART)
FIG. 1 is a partially broken-away plan view of a conventional inkjet printer head.

The present invention will now be described more fully hereinafter with reference to the accompanying drawings. In the drawings, the thickness of layers and regions are exaggerated for the sake of clarity. Also, when a layer is described as being "on" another layer or substrate, such a description encompasses the case in which the layer in question is disposed directly on the other layer or substrate, and the case in which other layers are interposed therebetween. Still further, like reference numerals designate like elements throughout the drawings.

Figure 3:
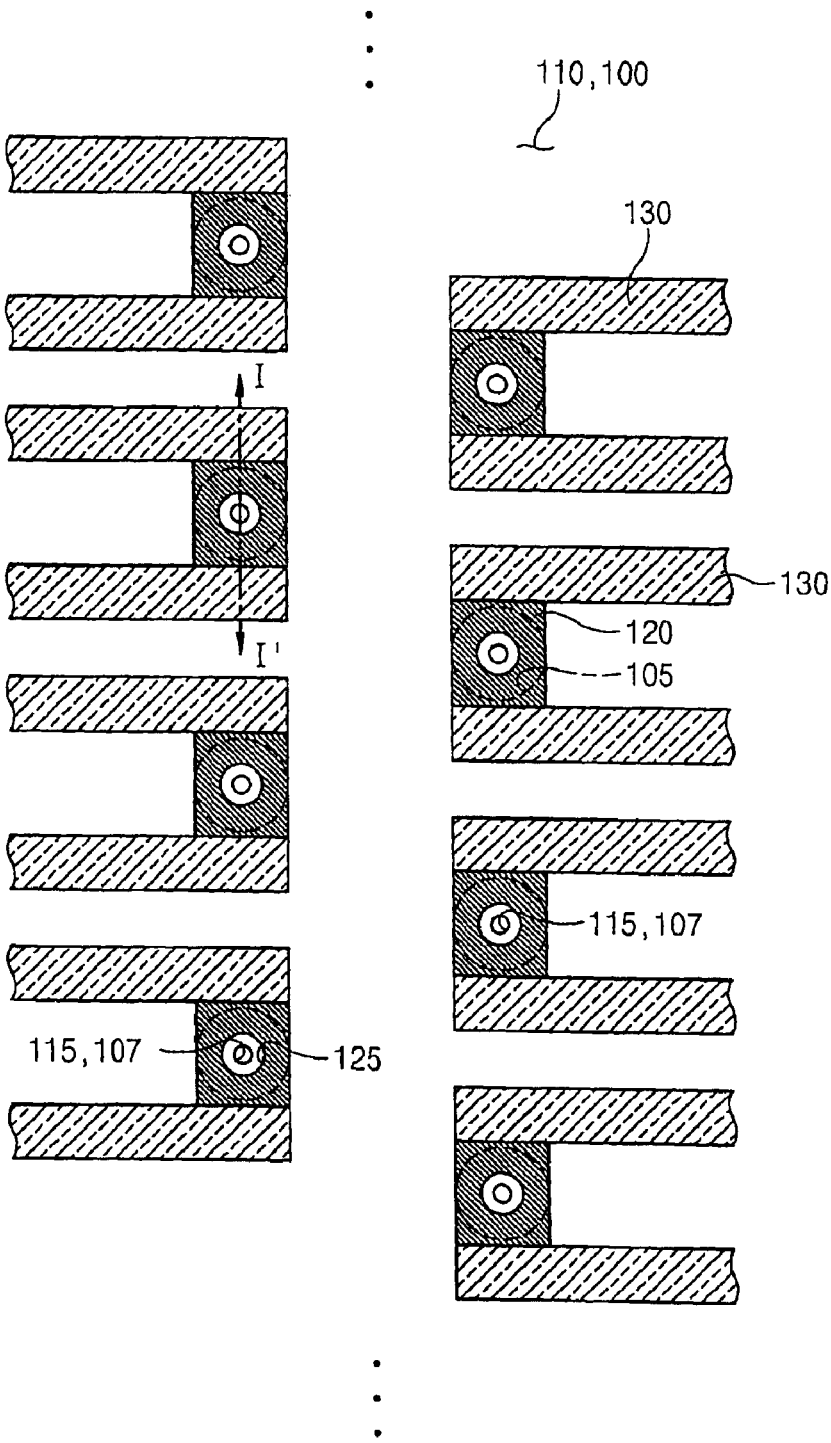
FIG. 3 is a plan view of an inkjet printer head according to the present invention.
Figure 4:
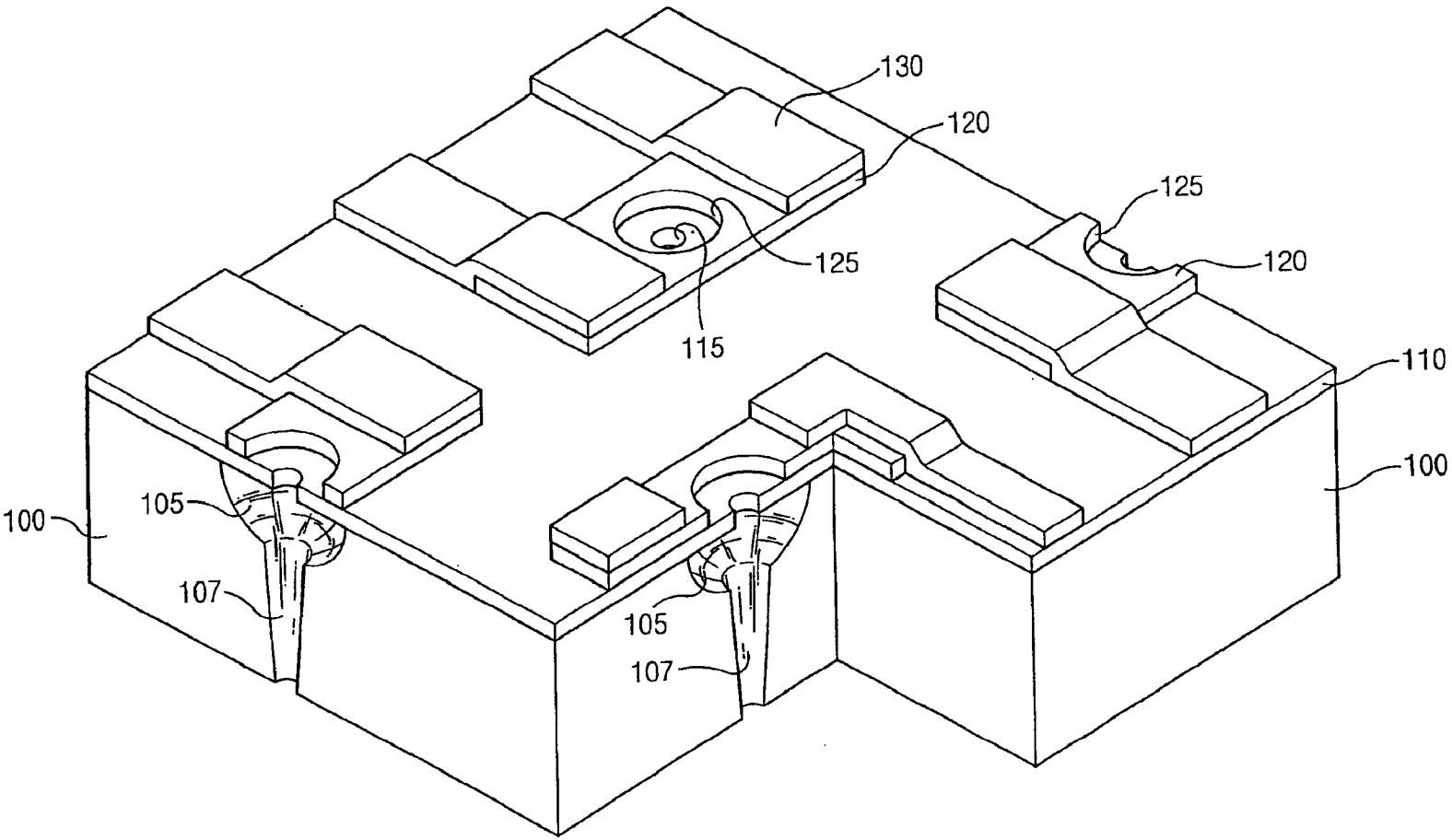
FIG. 4 is a perspective view of the inkjet printer head according to the present invention.

Referring now to FIGS. 3 and 4, the inkjet printer head according to the present invention comprises a semiconductor wafer 100 in which a lower nozzle portion 107 and an upper nozzle portion 105 are formed. An opening extending through the semiconductor wafer 100 constitutes the lower nozzle portion 107 and the upper nozzle portion 105. Both the lower nozzle portion 107 and the upper nozzle portion 105 have a circular cross section and may have a common center. The width of the upper nozzle portion 105 is greater than that of the lower nozzle portion 107. More particularly, in three dimensions, the upper nozzle portion 105 is hemispherical, whereas the lower nozzle portion 107 is preferably frustoconical. That is, an inlet end of the lower nozzle portion 107 adjacent the upper nozzle portion 105 is preferably wider than an outlet end thereof defined at the lower surface of the semiconductor wafer 100.

A support layer 110 is disposed on the surface of the semiconductor wafer 100 to which the upper nozzle portion 105 opens, thereby covering the upper nozzle portion 105 and giving it its hemispherical shape. The support layer 110 has an opening 115 coincident with the common central axis of the upper and lower nozzle portions 105 and 107. Preferably, the support layer 110 is formed of at least one material selected from the group consisting of silicon oxide, silicon nitride, and silicon carbide.

A resistor pattern 120 extends along the support layer 110 across the upper nozzle portion 105 and has an opening 125 that is wider than the opening 115 of the support layer 110. The resistor pattern 120 preferably extends across all of the upper nozzle portions 105. Interconnections 130 are coupled with both endpoints of the resistor pattern 120. An ink cartridge (200 in FIG. 8) is attached to the semiconductor wafer 100 in order to supply ink to the upper nozzle portion 105. The ink cartridge supplies the ink to the upper nozzle portion 105 through the opening 115 of the support layer 110. To this end, the ink cartridge is attached to one side, i.e., the upper surface, of the semiconductor 100 where the interconnections 130 are formed.

The resistor pattern 120 is one form of an ink ejection unit used in inkjet printers and may thus be used in a thermal inkjet printer according to the present invention. The resistor pattern 120 is preferably formed of tantalum aluminum (TaAl) or one of other various materials that have high resistivities. Alternatively, piezoelectric materials may be used for the ink ejection unit. The interconnections 130 are preferably formed of a metallic material having a low resistivity.

Heat is generated in the path of the electric current, which path extends through the resistor pattern 120 between the interconnections 130. Ink in the upper nozzle portion 105 is evaporated by heat generated from the resistor pattern 120. The inner pressure of the upper nozzle portion 105 is thus increased to cause ink to be ejected from the lower nozzle portion 107. The ink is ejected several tens to several ten thousand times a second. According to the present invention, the resistor pattern 120 and the interconnections 130 are effectively cooled by the ink in the ink cartridge because the ink cartridge is disposed on the resistor pattern. Thus, the present invention can prevent the resistor pattern 120 from being damaged by being over-heated, i.e., prevents the residual heat phenomenon from occurring.

Furthermore, a protective layer is preferably interposed between the resistor pattern 120 and interconnections 130, and the ink cartridge. The protective layer is formed of at least one material selected from the group consisting of silicon oxide, silicon nitride, silicon carbide, and tantalum. Another opening is preferably formed in the protective layer to expose the openings 115 and 125 so that ink from the ink cartridge can be supplied toward the upper nozzle portion 105.

A method of fabricating the printer head according to the present invention will now be described with reference to FIGS. 5–8.

Figure 5:
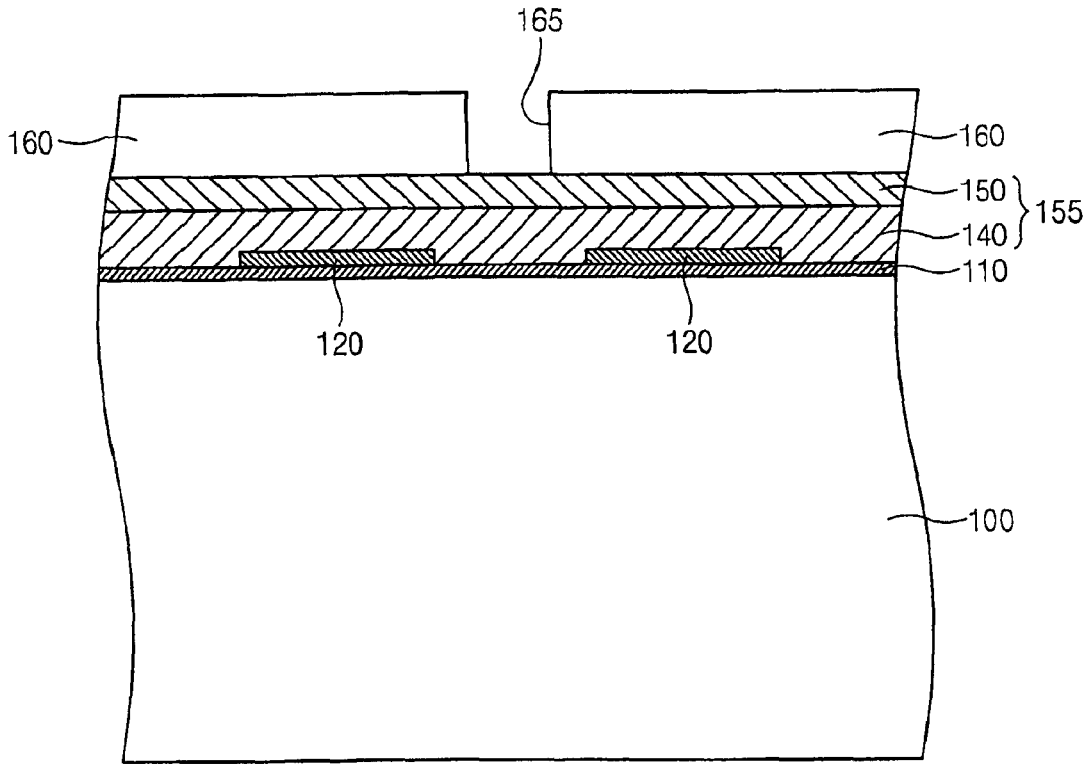
FIGS. 5 through 8 are cross-sectional views illustrating a method of fabricating the inkjet printer head according to the present invention.

Referring first to FIG. 5, a supporting layer 110 is formed on a semiconductor wafer 100. The supporting layer 110 is preferably formed of at least one material selected from the group consisting of silicon oxide, silicon nitride, and silicon carbide.

A resistor pattern 120 is formed on the supporting layer 110. The resistor pattern 120 is preferably formed by forming a layer of aluminum tantalum on the supporting layer 110, and then patterning the resulting layer. In the conventional heating type of inkjet printer, the temperature of the resistor pattern 120 should be several hundred ° C. for the ink ejection. This temperature can be achieved by providing a resistor pattern 120 having an appropriate resistance, which resistance depends on the thickness thereof. And, any of various materials may be used for forming the resistor pattern 120 so long as the specific resistance of the material allows the resistor pattern 120 to produce the temperature required for ejecting the ink.

Subsequently, interconnections (130 of FIG. 4) are formed on the supporting layer 110 to electrically connect respective ends of each respective portion of the resistor pattern 120. However, an isolation pattern, a gate pattern, and a source/drain are performed by a series of processes, known per se, before the resistor pattern 120 is formed. The supporting layer 110 may be formed of the isolation pattern.

A protective layer 155 is formed on the entire surface of the semiconductor wafer 100 on which the resistor pattern 120 is formed. The protective layer 155 may comprise a lower layer 140 and upper layer 150 which are sequentially stacked one atop the other. The lower layer 140 is of at least one material selected of the group consisting of silicon carbide, silicon nitride, and silicon oxide. The upper layer 150 is preferably of tantalum to prevent an abnormal reaction thereof with the ink. A photoresist pattern 160 having an opening 165 is formed on the upper layer 150 such that the opening 165 exposes a predetermined region of the upper layer 150. The opening 165 of the photoresist pattern 160 preferably has a width of about 20 to 40 $\mu$m.

Figure 6:
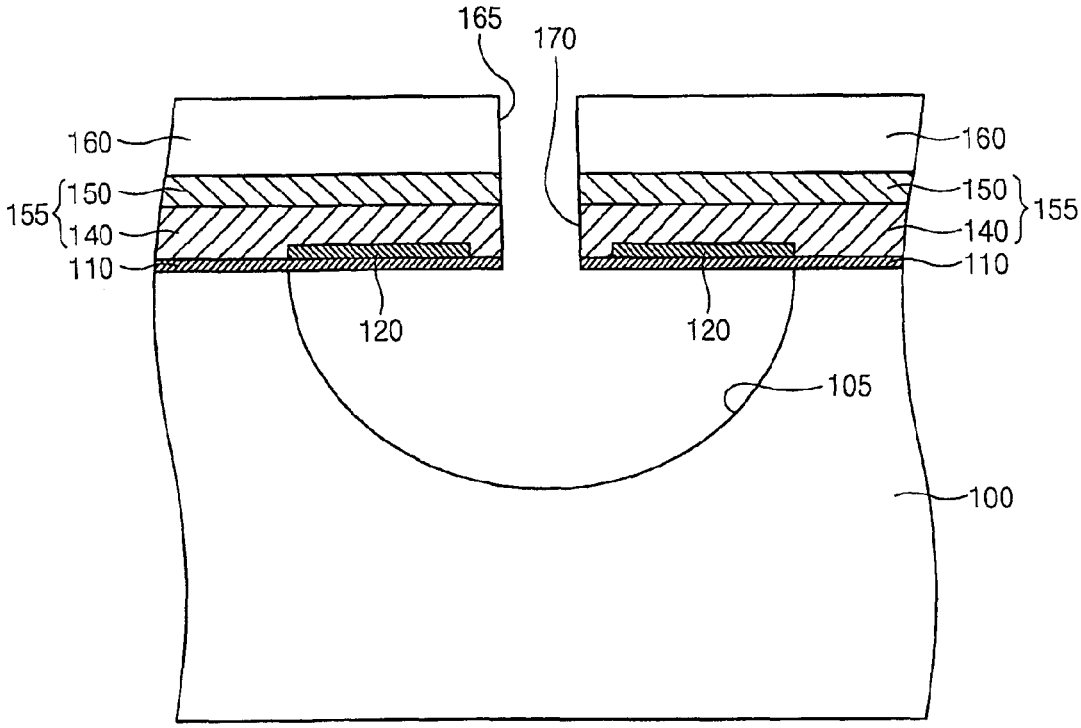

Referring to FIG. 6, the upper layer 150, the lower layer 140, and the support layer 110 are sequentially etched using the photoresist pattern 160 as an etch mask. Thus, an opening 170 that exposes the surface of the semiconductor wafer 100 is formed in the protection layer, and supporting layer 110. Preferably, the opening 170 extends through the resistor pattern 120, as well. The resistor pattern 120 may also have an opening 125, as shown in FIG. 4. The opening 125 of the resistor pattern 120 is preferably wider than the opening 115 of the support layer 110.

The semiconductor wafer 100 exposed through the opening 170 is isotropically etched to form an upper nozzle portion 105, which is hemispherical, under the resistor pattern 120. The upper nozzle portion 105 is formed in such a way that the bottom surface of the support layer 110 under the resistor pattern 120 is exposed. The upper nozzle portion 105 is preferably formed using an isotropic etch process having an etch selectivity with respect to the protective layer 155 and the support layer 110. Xenon difluoride ($XeF_2$) is preferably used as the etch gas in the forming of the upper nozzle portion 105.

Figure 7:
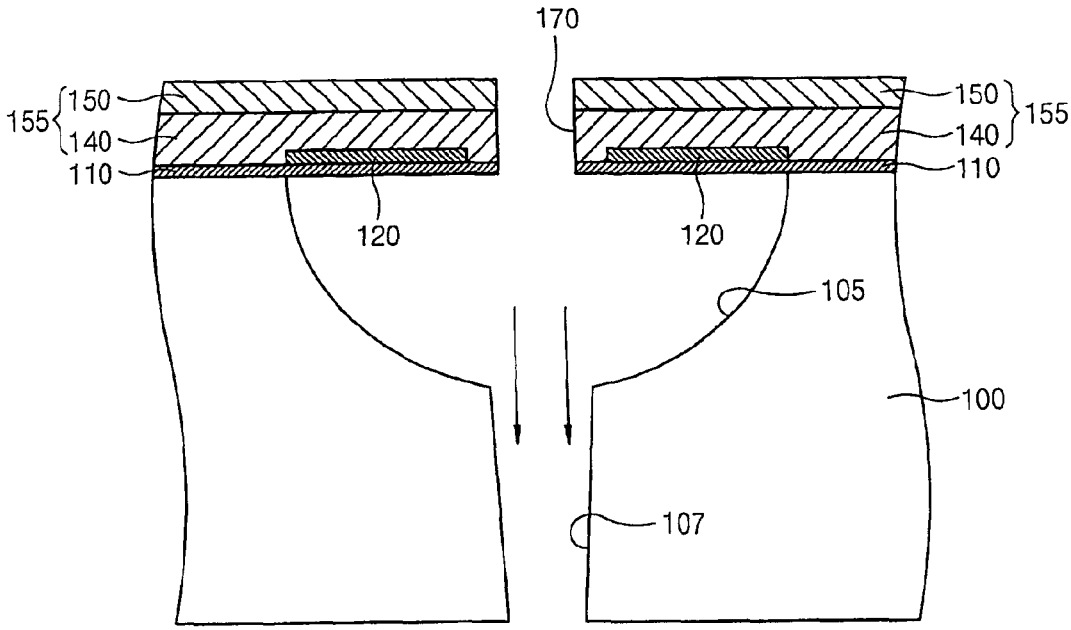

Referring to FIG. 7, the bottom surface of the upper nozzle portion 105, exposed through the opening 170, is then anisotropically etched to form a lower nozzle portion 107 in the semiconductor wafer 100.

Preferably, the lower nozzle portion 107 is formed by an anisotropic etching process using the photoresist pattern 160 as an etching mask. To facilitate the ink ejection, the outlet of the lower nozzle portion 107 at the bottom surface of the semiconductor wafer is preferably narrower than the inlet thereof that opens to the upper nozzle portion 105. To this end, the etching process for forming the lower nozzle portion 107 may be comprise both anisotropic and isotropic etching.

Meanwhile, if the semiconductor wafer 100 were somewhat thick, the photoresist pattern 160 could be removed during the etching process of forming the lower nozzle portion 107, whereupon the upper surface of the protection layer 155 would be exposed or etched back. Thus, the etching process for forming the lower nozzle portion 107 preferably has a high etch selectivity with respect to the upper layer 150. In addition, the initial thickness of the protection layer 155 is selected in consideration of the amount that the thickness thereof will be reduced while the lower nozzle portion 107 is being formed.

Any remaining photoresist pattern 160 is removed to expose the upper layer 150 after the lower nozzle portion 107 is formed. The photoresist pattern 160 may be consumed during the etching process for forming the upper nozzle portion 105.

Figure 2:
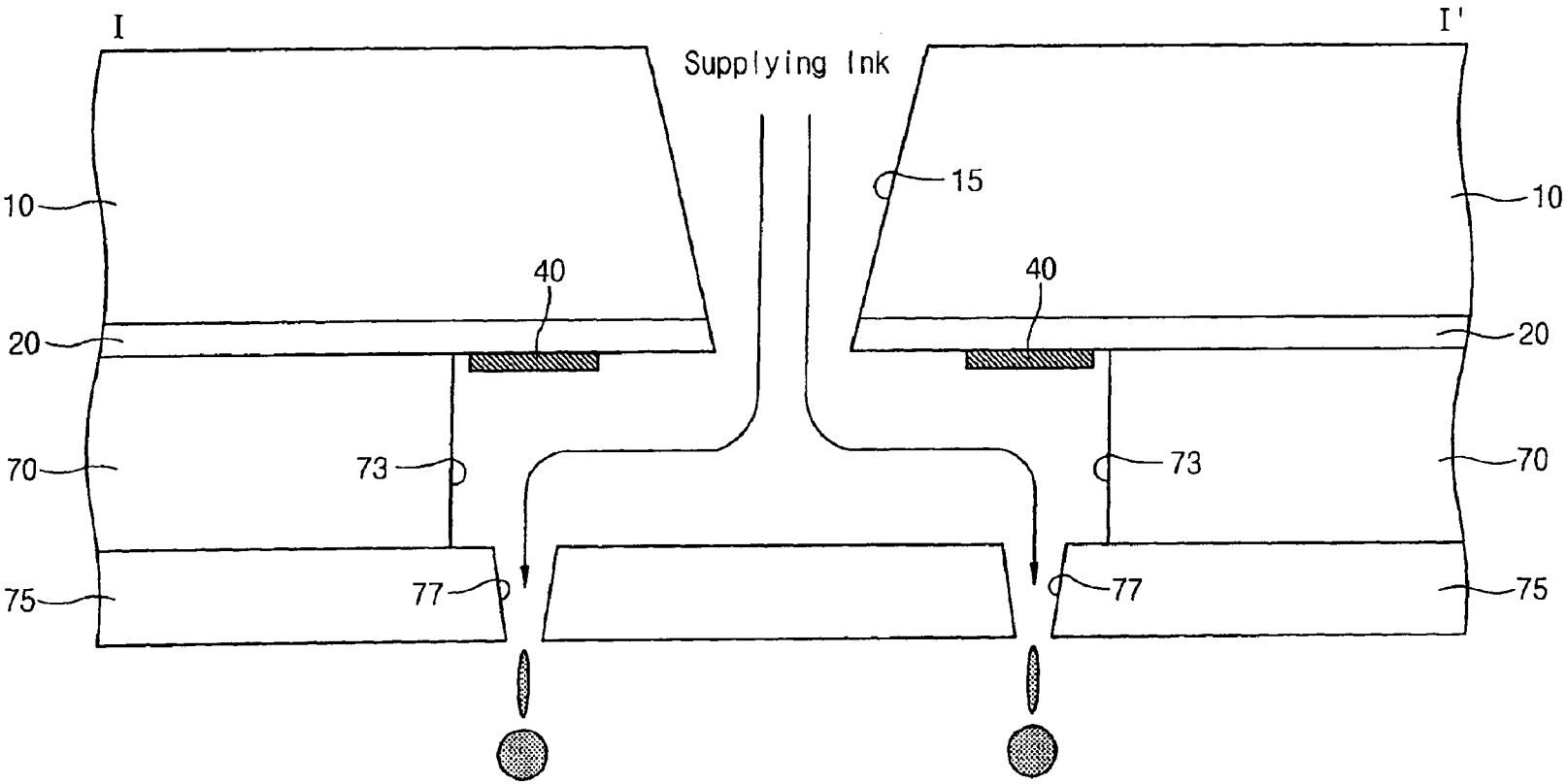
Fig. 2 (PRIOR ART)
FIG. 2 is a cross-sectional view of the conventional inkjet printer head as taken along line I—I' of FIG. 1.

The lower and upper nozzle portions 107 and 105 constitute an ink chamber for storing ink. Thus, the ink chamber according to the present invention is formed in the semiconductor wafer 100, unlike the conventional ink chamber that is defined by a separate orifice layer (75 of FIG. 2).

Figure 8:
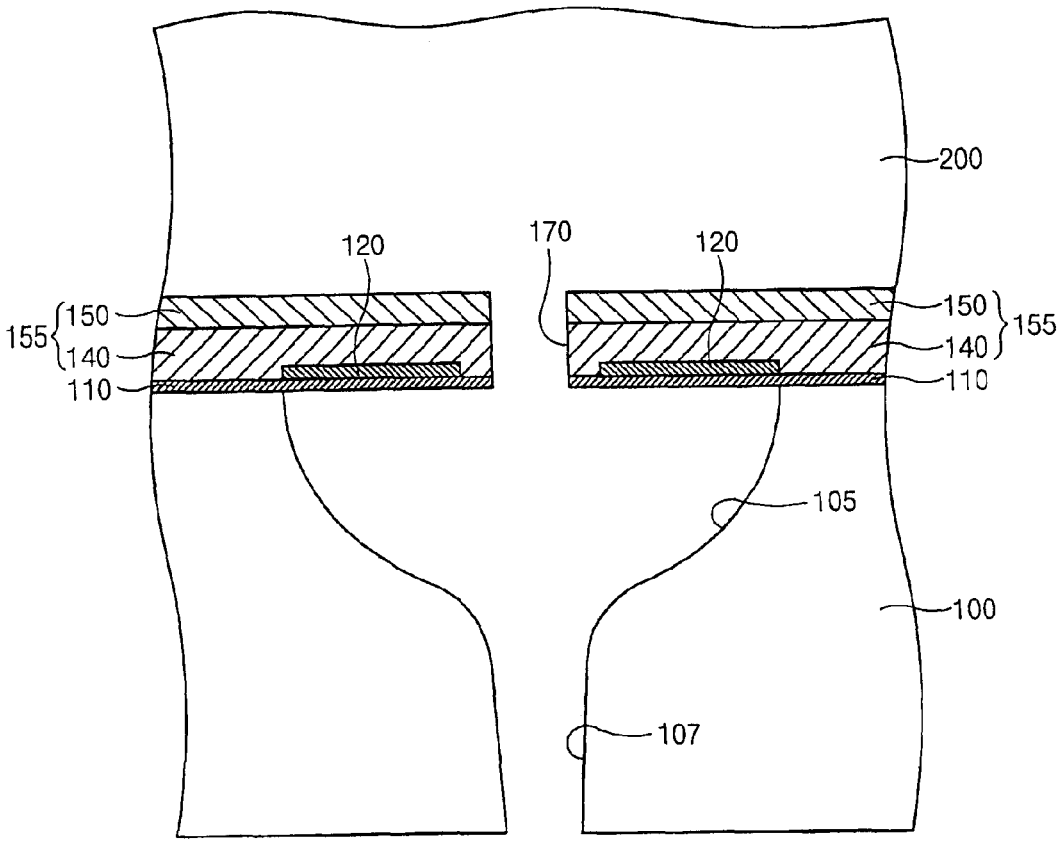

Referring to FIG. 8, an ink cartridge 200 is attached to the semiconductor wafer 100 from which the photoresist pattern 160 has been removed.

To improve the ink ejection, the intersection of the upper and lower nozzle portions 105 and 107 is preferably curved. A rounding process is performed round off the boundary where the upper and lower nozzle portions 105 and 107 meet. The rounding process may comprise a thermal oxidation of the structure from which the photoresist pattern 160 has been removed, and the removing of the resulting silicon oxide. In this case, silicon atoms of the semiconductor wafer 100 are consumed to produce the silicon oxide. The silicon oxide will be thinner on the broader surfaces of the upper and lower nozzle portions 105 and 107 than at the edge where the upper and lower nozzle portions 105 and 107 meet. Therefore, the intersection of the upper and lower nozzle portions 105 and 107 will be curved when the silicon oxide is removed, whereby the ejecting of the ink will be facilitated by the curved profile offered by the nozzle portions 105 and 107.

The initial thickness of the semiconductor wafer 100 ranges from 0.5 to several millimeters in order to prevent the wafer from being damaged, e.g., from being broken, during the fabrication process. However, according to the present invention, the semiconductor wafer 100 can be even thinner because the semiconductor wafer 100 is itself used as the nozzle for ejecting the ink. In this case, one surface of the semiconductor wafer 100, preferably, the lower surface of the semiconductor wafer 100, is ground. The grinding process may be a conventional wafer back-grinding process, which is typically otherwise performed before the process of packaging semiconductor devices. The grinding process may be performed before the supporting layer 110 is formed, as shown in FIG. 5, or after the lower nozzle portion 107 is formed. If the grinding process is performed after the lower nozzle portion 107 is formed, the semiconductor wafer 100 does not have to be etched through to form the lower nozzle portion 107. Rather, the lower nozzle portion 107 is preferably etched to a depth within semiconductor wafer 100, and the bottom of the lower nozzle portion 107 is exposed once the semiconductor wafer 100 is ground, whereby the outlet of the lower nozzle portion opens to the ground bottom surface of the semiconductor wafer 100.

Alternatively, the rounding process may be performed after the grinding process. Also, a cleaning process, which is performed before the ink cartridge 200 is attached to the semiconductor wafer 100, may be used as the rounding process.

The semiconductor wafer 100 having the lower nozzle portion 107 is attached to the ink cartridge 200 using an adhesive resin such as epoxy. Here, ink contained in the ink cartridge 200 is supplied to the upper and lower nozzle portions 105 and 107 through the opening 170. According to the present invention, the upper and lower nozzle portions 105 and 107 are aligned with the resistor pattern 120. The alignment can be accurate to within less than 0.5 $\mu$m by using known methods for fabricating semiconductor devices. Thus, the misalignment between the resistor pattern and the nozzle portion can be minimal.

That is, according to the present invention, the resistor pattern can be exactly aligned with the nozzle portion because the nozzle and resistor pattern are formed by high-precision techniques well-known in the field of fabricating semiconductor devices.

Also, the inkjet printer head according to the present invention comprises upper and lower nozzle portions which extend through the body of the semiconductor wafer, a resistor pattern which crosses over the upper nozzle portion, and an ink cartridge for supplying ink. In this case, ink is supplied to the upper nozzle portion from a location adjacent the upper surface of the resistor pattern, thereby effectively cooling the resistor pattern. As a result, the inkjet printer head according to the present invention is not prone to experiencing the residual heat phenomenon that occurs in the prior art. Accordingly, the ink jet printer head is less likely to be damaged.

In addition, according to the present invention, since the semiconductor wafer is used as a nozzle, the inkjet printer head has excellent wear-resistant characteristics.

Finally, although the present invention has been particularly shown and described with reference to the preferred embodiments thereof, various changes in form and details may be made thereto without departing from the true spirit and scope of the invention as defined by the appended claims.

What is claimed is:

1. An inkjet printer head comprising:

a semiconductor wafer having an opening extending therethrough, said opening defining a nozzle for ejecting ink and including a hemispherical cavity that forms a hemispherical portion of the nozzle;

an ink cartridge disposed on one side of said semiconductor wafer and communicating with the nozzle of said semiconductor wafer so that ink is supplied from said ink cartridge to the nozzle;

a supporting layer interposed between said ink cartridge and said semiconductor wafer, the supporting layer having an opening located over the hemispherical portion of said nozzle; and a patterned resistor interposed between said supporting layer and said ink cartridge and disposed over said nozzle.

2. The inkjet printer head as claimed in claim 1, wherein the supporting layer is of at least one material selected from the group consisting of silicon oxide, silicon nitride and silicon carbide.

3. The inkjet printer head as claimed in claim 1, wherein said nozzle has a lower portion disposed beneath the hemispherical portion thereof, the lower portion of said nozzle having central axis passing through the opening in said supporting layer.

4. The inkjet printer head as claimed in claim 1, and further comprising a protective layer interposed between said supporting layer and said ink cartridge, said protective layer covering said patterned resistor.

5. The inkjet printer head as claimed in claim 4, wherein said protective layer is of at least one material selected from the group consisting of silicon oxide, silicon nitride, silicon carbide, and tantalum.

6. A method of fabricating an inkjet printer head, comprising steps of:

providing an ink ejection unit having an opening therethrough on a semiconductor wafer, whereby the opening exposes the top surface of the semiconductor wafer, wherein providing the ink injection unit comprises:

forming a supporting layer on the semiconductor wafer, forming a resistor in a pattern on the supporting layer, forming a protective layer over the semiconductor wafer on which the resistor has been formed, and sequentially patterning the protective layer and the supporting layer to form said opening of the ejection unit;

etching the semiconductor wafer at the exposed top surface thereof to form an opening in said wafer, the opening constituting a nozzle through which ink is to be injected by the printer head; and attaching an ink cartridge to the semiconductor wafer over the top surface thereof in order to supply ink to the nozzle.

7. The method as claimed in claim 6, wherein the forming of the nozzle comprises isotropically and anisotropically etching the semiconductor wafer via said opening in the ink ejection unit.

8. The method as claimed in claim 6, wherein the forming of the supporting layer comprises forming a layer of at least one material selected from the group consisting of silicon oxide, silicon nitride, silicon carbide, and tantalum on the semiconductor wafer.

9. The method as claimed in claim 6, wherein the forming of the resistor comprises forming a layer of tantalum aluminum on the supporting layer, and patterning the layer of tantalum aluminum.

10. The method as claimed in claim 6, wherein the forming of the protective layer comprises forming at least one layer of silicon oxide, silicon nitride, and silicon carbide over the semiconductor wafer.

11. The method as claimed in claim 6, wherein the forming of the ink ejection unit comprises forming a layer piezoelectric material on the semiconductor wafer.

12. The method as claimed in claim 6, wherein the etching of the semiconductor wafer comprises:

isotropically etching a portion of the semiconductor wafer exposed through the opening in the ink ejection unit so as to form a hemispherical cavity constituting a hemispherical upper portion of the nozzle under the ink ejection unit, and subsequently anisotropically etching the semiconductor wafer through the opening in the ink ejection unit so as to form a lower portion of the nozzle extending from the bottom of said hemispherical cavity.

13. The method as claimed in claim 12, wherein the isotropic etching of the semiconductor wafer is performed using an etch recipe having an etch selectivity with respect to the ink ejection unit.

14. The method as claimed in claim 12, wherein the isotropic etching of the semiconductor wafer is performed using xenon difluoride as an etch gas.

15. The method as claimed in claim 12, wherein the etching of the semiconductor wafer further comprises isotropically etching the wafer after said lower portion of the nozzle is formed to round off a part of the wafer at the boundary where the lower portion and the upper portion of the nozzle meet.

* * * * *